US006109068A

United States Patent [19]

Stoll et al.

[11] Patent Number: 6,109,068

[45] Date of Patent: Aug. 29, 2000

[54] METHOD OF PRODUCING SPACIAL, SINGLE- AND MULTI-LAYER KNITTED ARTICLES ON FLAT KNITTING MACHINE

[75] Inventors: Thomas Stoll, Reutlingen; Wolfgang Rempp, Gammertingen, both of Germany

[73] Assignee: H. Stoll GmbH & Co., Reutlingen, Germany

[21] Appl. No.: 09/066,022

[22] Filed: Apr. 24, 1998

[30] Foreign Application Priority Data

Apr. 25, 1997 [DE] Germany ..... 197 17 415

[51] Int. Cl.[7] ..... D04B 7/10

[52] U.S. Cl. ..... 66/70; 66/75.1; 66/76

[58] Field of Search ..... 66/77, 62, 64, 66/70, 69, 71–76, 60 R, 75.1

[56] References Cited

U.S. PATENT DOCUMENTS

| | | | |
|---|---|---|---|
| 2,616,275 | 11/1952 | Bennington | 66/70 |
| 5,432,030 | 7/1995 | Vourlis . | |
| 5,452,592 | 9/1995 | Kobota et al. | 66/60 R |
| 5,606,875 | 3/1997 | Nishitani | 66/77 |

FOREIGN PATENT DOCUMENTS

| | | |
|---|---|---|
| 2 113 177 | 6/1972 | France . |
| 35 19 677 A1 | 12/1986 | Germany . |
| 39 37 406 A1 | 5/1991 | Germany . |
| 196 16 003 A1 | 10/1997 | Germany . |
| 2 309 709 | 8/1997 | United Kingdom . |

*Primary Examiner*—Danny Worrell
*Attorney, Agent, or Firm*—Michael J. Striker

[57] ABSTRACT

A method of producing of spacial, single or multi-layer knitting articles on a flat knitting machine having at least two needle beds and a loop transfer device, has the steps of knitting of knitting rows with a number and width a corresponding to a spacial structure of a knitting article to be produced and corresponding to material and machine properties, selecting a sequence of the knitting rows so that a maximum possible uniform distribution of the knitting rows of different width and thereby reverse points in a knitting direction over the knitted article is provided, and for each loop row selecting a loop size so that a desired geometrical structure of the knitting article is obtained in an optimal manner.

31 Claims, 5 Drawing Sheets

METHOD OF PRODUCING SPACIAL, SINGLE- AND MULTI-LAYER KNITTED ARTICLES ON FLAT KNITTING MACHINE

BACKGROUND OF THE INVENTION

The present invention relates to a method of producing spacial, single-or multi-layer knitted articles on a flat knitting machine with at least two needle beds and a loop transfer device.

For technical knitted articles in particular, such as reference materials or inserts for protective helmets, convexities or depressions of the flat knitting articles were made by a so-called gusset technique. With the standard gusset technique the successive loop rows are progressively reduced or expanded as to their width. The reverse points of the knitting direction are thereby located however on a line in the knitting. Since at the reverse points of the knitting direction no openings are produced due to the fact that the knitting threads form a float elongation from the end of one knitting row to the beginning of the next knitting row float, the knitted article is weakened on the so-called gusset lines of the reverse points. This is frequently not tolerable, in particular for knitting of technical articles. These disadvantages can be eliminated when the reverse points of the knitting direction are uniformly distributed over the knitting. The obtaining of the theoretically geometrical ideal form of the knitting article is set however within certain limits by a machine parameter such as the needle distance.

SUMMARY OF THE INVENTION

Accordingly, it is an object of the present invention to provide a method of producing spacial, single-or multi-layer knitting articles on a flat knitting machine, which avoids the disadvantages of the prior art.

In keeping with these objects and with others which will become apparent hereinafter, one feature of the present invention resides, briefly stated, in a method which is characterized by the knitting of knitting rows with a number and width corresponding to the spacial structure of the knitting article to be produced and corresponding to the material and machine properties, wherein the thickness of the knitting rows is selected so that a maximum possible uniform distribution of the knitting rows of different widths and therefore the reverse points of the knitting direction over the knitted article is performed, and for each loop row the loop size is selected so that the desired geometrical structure of the knitted article is obtained in an optimal manner.

Because of the individual design of the loop sizes in each knitting row, the theoretical ideal form, for example a spherical form of the knitting can be obtained much better than during knitting with constant loop sizes. The sizes of the loops within a knitting row can be also varied in order to achieve the directive of the maximum possible optimal geometrical structure of the knitting. The openings which are formed at the reverse points of the knitting direction can be closed during the manufacturing process by specifically formed loops.

An exceptionally important advantages can be obtained in that, during knitting of the loop rows individual or multiple loops can be transferred on other needles of the same or another needle bed, so that therefore the desired geometrical structure of the knitting is obtained better. Moreover, with the combination of this transfer technique, the production of pocket-like depressions of arbitrary width and the like is possible. Also, the production of spacial knitting with corners and edges is facilitated by transferring of the individual loops.

The knitting produced in accordance with the present invention, can be provided, in addition with at least one region with corners and edges, also with one or several spherical regions. A combination of all possible spacial formations can be provided. Moreover, by the transfer of loops the tension occurring during the knitting process in the knitting can be reduced, so that the danger of a thread tearing off is substantially reduced.

The knitting article can be produced with any binding technique and any patterns. For increasing the productivity of the method, the neighboring segments of the knitting article can be knitted with separate knitting systems parallel to one another without any loss of the geometrical accuracy of the knitted article. This technique makes possible also intarsia-like transitions which can be color identical or different and can be formed with different thread guides and knitting systems without interfering field limits.

For minimizing the knitting time, the arrangement of the individual knitting rows with respect to the knitting system of the machine can be provided by a computer, since thereby the smallest number of carriage movements can be provided. It is also possible to reinforce the knitted article by insertion of weft or warp threads and/or multiaxially introduced threads. Additionally, on the knitted article during their production, shackles, loops, slings and the like can be brought in any orientation to the knitting direction.

Such slings or loops are frequently knitted during technical knitting as mounting elements. No special working steps and production time are needed for co-knitting of these elements during the manufacture.

Cords and other mounting or closing elements can be inserted as weft or warp threads and connected at least locally with the knitted article. The connection between the cords and the knitted article can be performed so that the cords can absorb pulling forces. During an insertion of the cords in tuck technique, a greater length than the knitting width can be introduced in the knitting, so that the cord at one or several points is pulled outwardly of the knitting and mounted on hooks or the like without compressing the knitting.

In addition to knitting the spherical regions and/or regions with corners and edges suitable for example as coatings, the invention deals also with helmet inserts in form of spherical, seamless knittings produced in accordance with the applicant's invention, and in particular knittings used as hinge supports in form of two connected pipes which are arranged in one another and can be angled.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
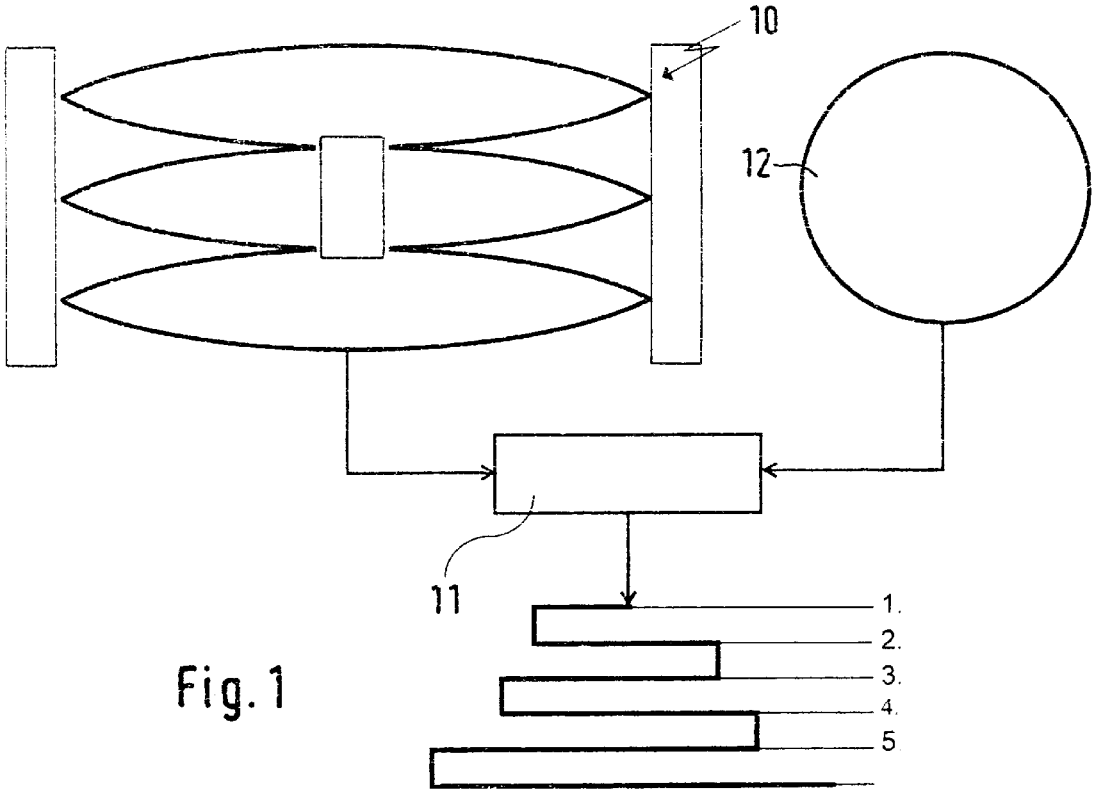
FIG. 1 is a view schematically showing a method of producing loop rows for a spherical knitting article in accordance with the present invention.

FIG. 1 illustrates the production of knitting rows 1–5 for forming a spherical knitting article 10. For this purpose the spherical shape to be produced is subdivided into flat structures suspended on one another, and these data are stored in a computer 11. The computer 11 also contains data about the utilized thread thickness and type, the desired loop size, as well as machine parameters, in particular the needle distance, which data are received from an input unit 12. From the geometrical data and the material as well as machine data and the loop size, the computer 11 generates a pattern program, in accordance with which the knitting rows 1–5 are formed. The reverse points of the knitting direction as well as the loop transverse points are distributed by the computer 11 uniformly over the knitting 10, so that no weakening lines are produced in the knitting 10. In addition, the knitting rows to be formed are distributed over the available knitting systems of the machine so that for complex knitting structures the smallest possible knitting time is provided.

Figure 2:
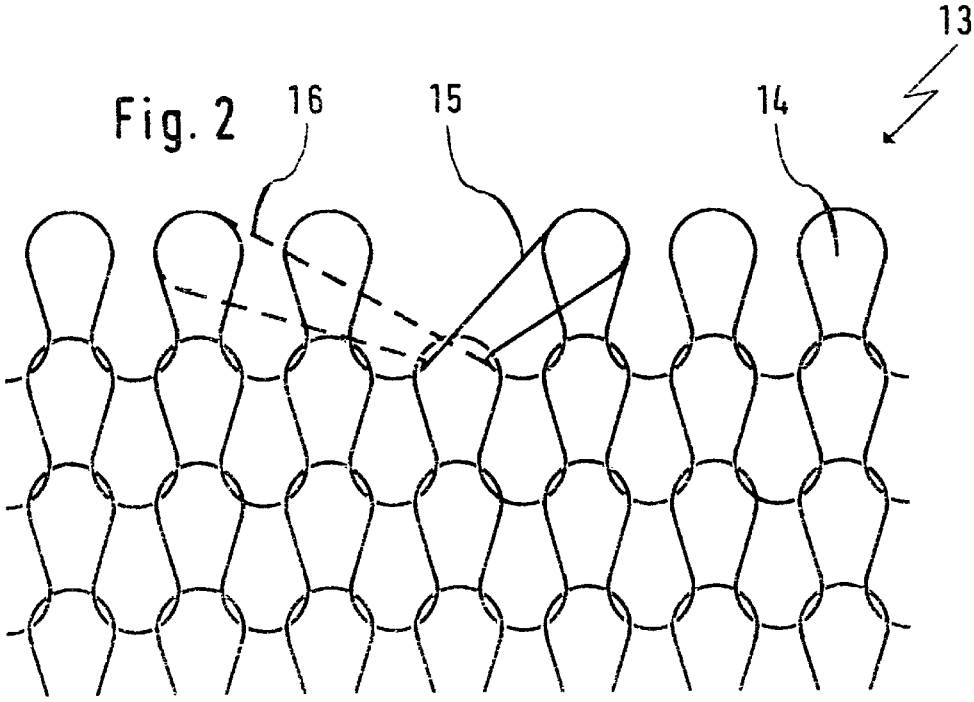
FIG. 2 is a view schematically showing a knitted article with different oriented loops.

FIG. 2 shows a section of a knitting 13 which has the loops 14 oriented in the knitting direction. Moreover, the knitting 13 has a loop 15 which is inclined to the right relative to the knitting direction, and a loop 16 which is inclined to the left opposite to the knitting direction by a greater angle. The different orientation of the loop 14, 15 and 16 can be carried out on the knitting articles which are curved or extend on a corner.

Figure 3:
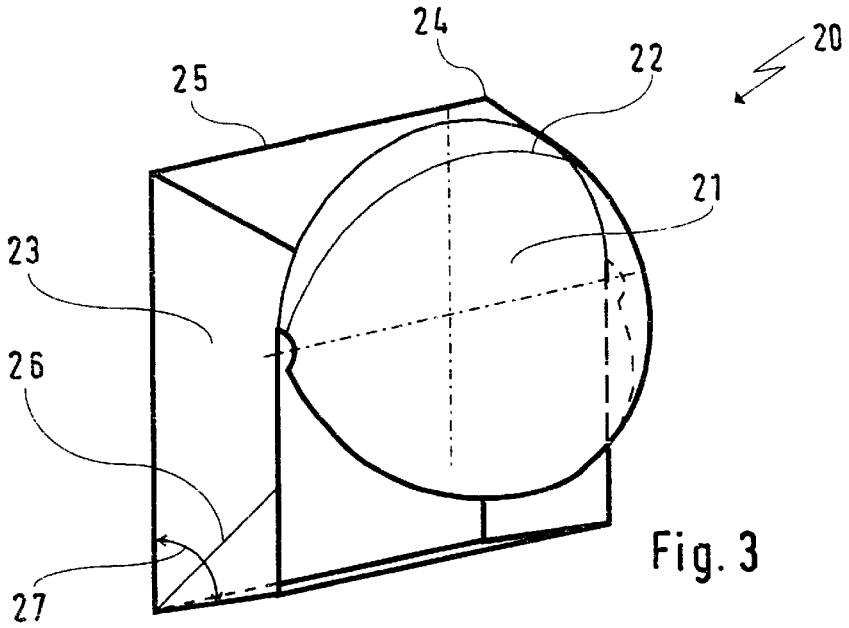
FIG. 3 is a perspective view of a special knitting.

FIG. 3 shows a knitting 20 which is composed of a spherical spacial sector 21 and a plane spacial sector 23. In the plane spacial sector 23 the corners 24 and the edges 25 are formed. The lines 22 and 26 identify segment borders, on which with the use of a conventional gusset technique, a gusset line would extend with openings due to the reverse lines of the knitting direction. However, in the inventive method they are dispensed with. The angle 27 which is formed by the plane spacial segments 23 with one another can be of any magnitude and in the shown example it is smaller than 90°.

Figure 4:
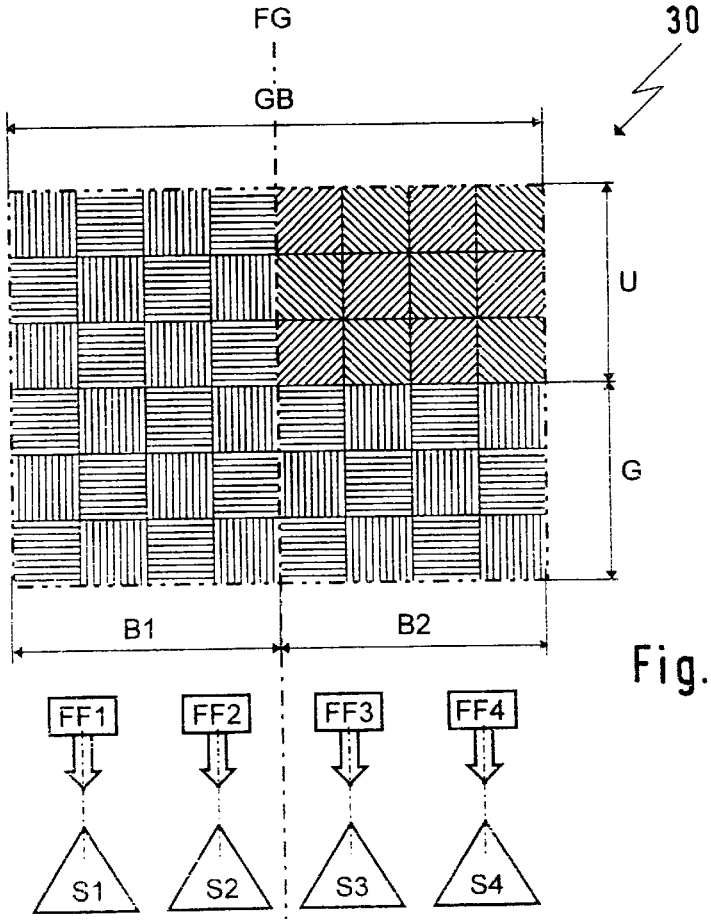
FIG. 4 is a view schematically showing the production of a knitted article with several knitting systems operating parallel to one another.

FIG. 4 schematically illustrates the production of a knitting 30 with a total knitting width GB. The knitting 30 is subdivided into a first half B1 and a second half B2. The line FG marks the so-called field border between the halves B1, B2, on which the intarsia-like transition from the knitting half B1 to the knitting B2 extends. Reference G identifies the corresponding knitting length, in which the knitting has the same pattern over the total width GB. Reference U identifies the knitting length in which the both halves B1 and B2 have different patterns. The first knitting half B1 is formed by two knitting systems S1 and S2 with the thread guides FF1 and FF2. The second knitting half B2 is knitted by the knitting systems S3 and S4 with the thread guides FF3 and FF4. The knitting systems S1 and S2 operate parallel to the knitting systems S3 and S4, so that the production size of the knitting 3 is a half, when compared with the technique with which the knitting systems are operative correspondingly over the total knitting width GB.

Figure 5:
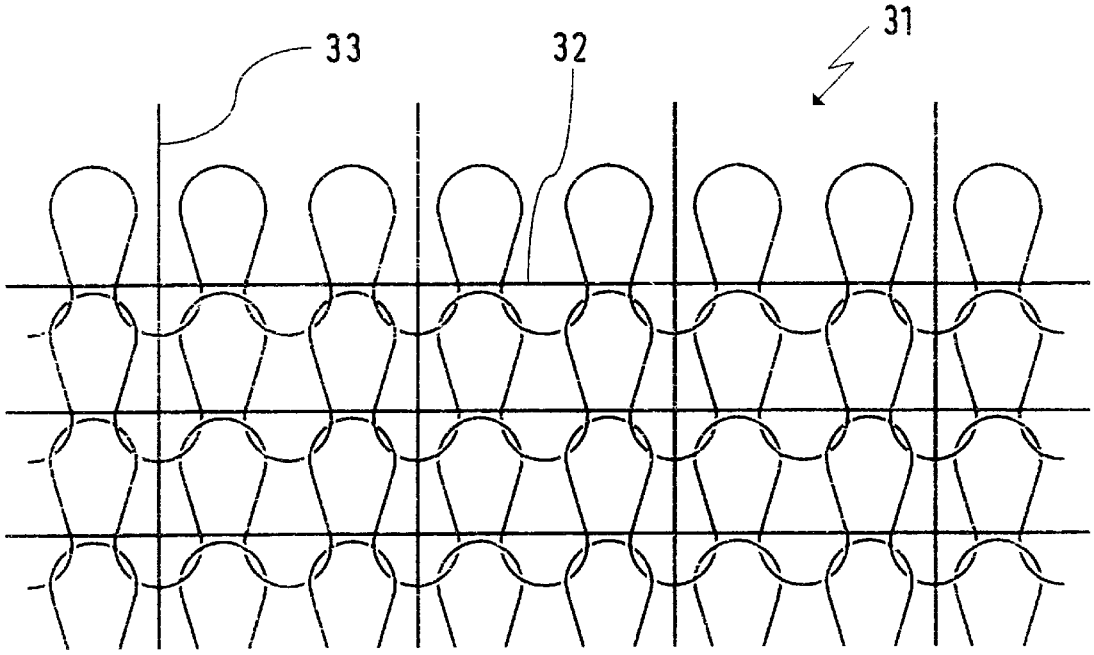
FIG. 5 is a view schematically showing a knitting with inserted warp and weft threads.

FIG. 5 shows a knitting 31 with binded weft threads 32 and warp threads 33. The threads 32 and 33 reinforce the knitting 31. They can impart special properties, for example a defined elasticity.

Figure 6:
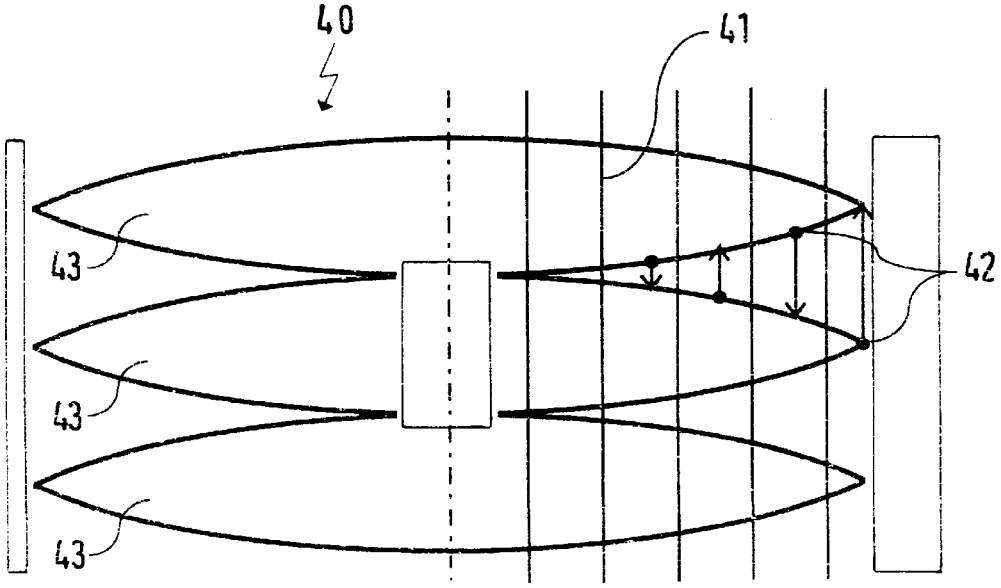
FIG. 6 is a view schematically showing a spherical knitted article with inserted warp threads.

FIG. 6 shows a spherical special knitting 40 in which the warp threads 41 are introduced. The warp threads insert is not however prevented by a throughgoing gusset zone. It extends through the total knitting because of the homogenous distribution of the connecting points 42 of the individual knitting segments 43 in unobjectionable way.

Figure 7:
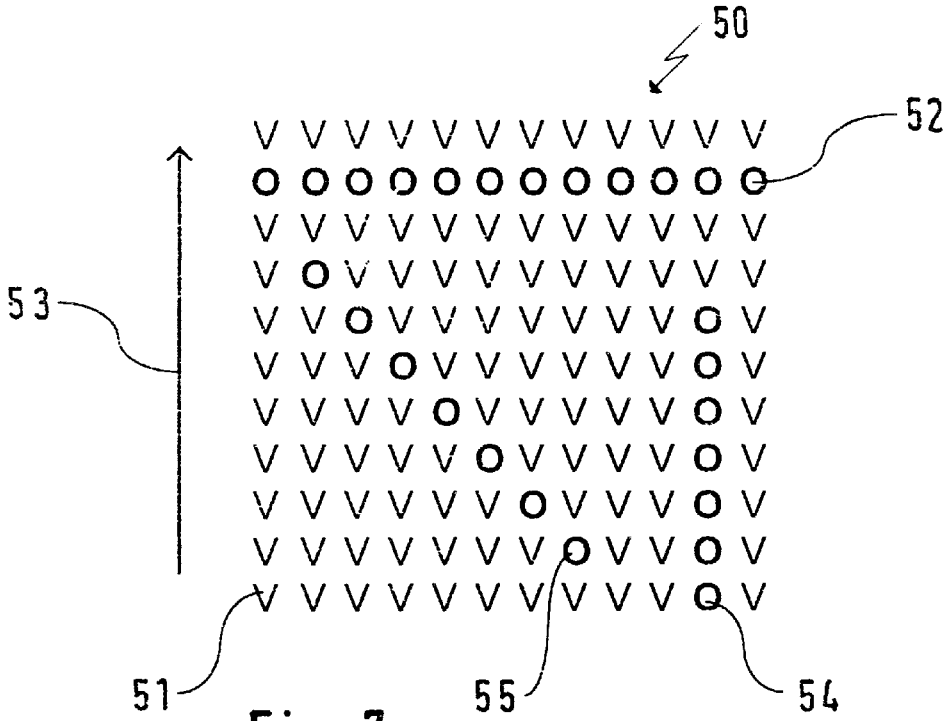
FIG. 7 is a view schematically showing a knitted article with mounting shackles.

FIG. 7 schematically shows a knitting 50 which, in addition to the loops 51 has also mounting loops 52 extending perpendicular to the knitting direction 53, mounting loops 54 extending parallel to the knitting direction 53, as well as mounting loops 55 extending inclinedly to the knitting direction 53.

Figure 8:
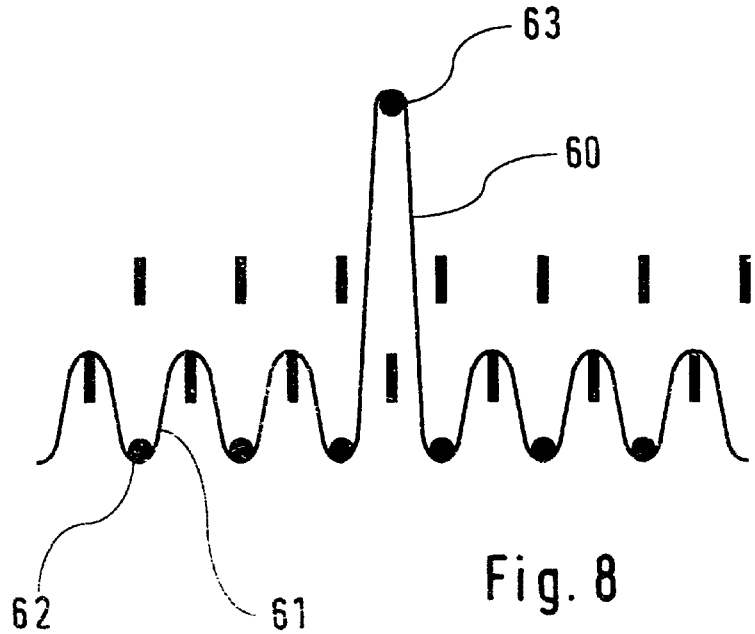
FIG. 8 is a view schematically showing the formation of a sling in a knitted article.

FIG. 8 illustrates the formation of a sling 60 in a knitting. Reference 61 identifies the loop of the knitting, while reference 62 identifies the needles of the front needle bed. The needles of the rear needle bed are identified with 63. In the first knitting row the threads are inserted only in the needles 62 of the front needle bed and the loops 51 are formed. In the next knitting row the needle 62 of the front needle bed again form the loops 61. In addition the threads are however introduced in the needle 63 of the rear needle bed. They form a tuck loop which forms the sling 60 on the rear side of the knitting. The size of the sling 60 is determined by the stripping depth of the needle 63. In the following knitting row the needle 62 of the front needle bed forms the loop 61, and the needle 63 of the rear needle bed releases the tuck loop formed in the preceding row.

Figure 9:
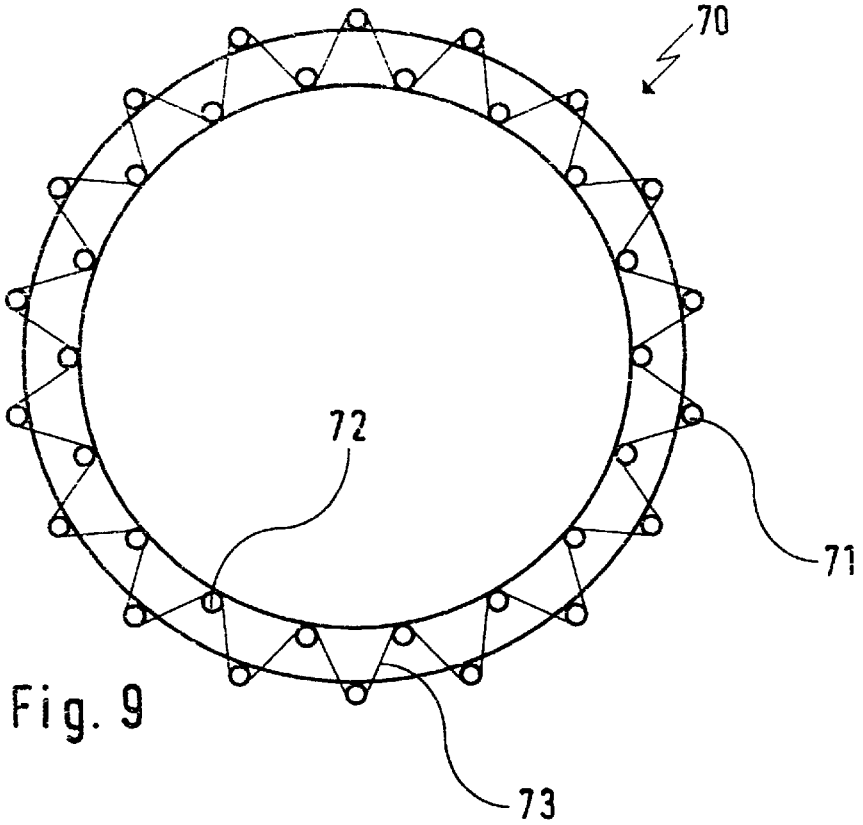
FIG. 9 is a view schematically showing a cross-section through the knitted article in FIG. 10.
Figure 10:
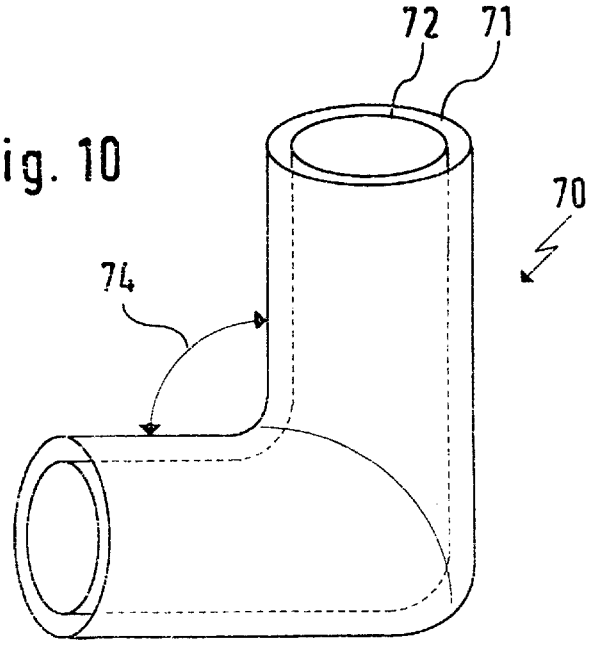
FIG. 10 is a view schematically showing a knitted piece in form of two pipes arranged in one another.

FIG. 9 shows the cross-section of the knitting 70 of FIG. 10. The knitting 70 is composed of a first partial knitting 71 which forms an outer pipe and a second pipe-shaped partial knitting 72 which is arranged inside the knitting 71. The space-forming thread insert between the knitting pieces 71 and 72 is identified with reference 73. On the perspective view of the knitting 70 shown in FIG. 10 it can be seen that both tubular knitting parts 71 and 72 which are located in one another are angled by angles 74. The angles 74 can have any arbitrary magnitude. The knitting 70 can be for example an orthopedic hinge support.

It will be understood that each of the elements described above, or two or more together, may also find a useful application in other types of methods differing from the types described above.

While the invention has been illustrated and described as embodied in method of producing spacial, single and multilayer knitted articles on flat knitting machine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of producing of spacial, single-or multi-layer knitting articles on a flat knitting machine having at least two needle beds and a loop transfer device, comprising the steps of knitting of knitting rows with a number and a width corresponding to a special structure of a knitting article to be produced; selecting a sequence of the knitting rows so that a uniform distribution of the knitting rows of different width and thereby reverse points in a knitting direction over the knitted article is provided, and for each loop row selecting a loop size so that a desired geometrical structure of the knitting article is obtained so as to avoid gusset lines on the reverse points.

2. A method as defined in claim 1; and further comprising transferring, during knitting of the loop rows, of an individual or several loops on other needles of a same needle bed or another needle bed, so as to obtain the desired geometrical structure of the knitted article in an optimal manner.

3. A method as defined in claim 1; and further comprising closing of openings occurring on reverse points of the knitted direction in the knitted article with correspondingly formed loops.

4. A method as defined in claim 1; and further comprising adjusting a size of each loop independently from a size of neighboring loops.

5. A method as defined in claim 1; and further comprising producing the knitting article in an arbitrary binding technique and arbitrary pattern.

6. A method as defined in claim 1; and further comprising knitting of adjoining segments of the knitted article with separate knitting systems parallel to one another.

7. A method as defined in claim 1; and further comprising reinforcing the knitting article by insertion of weft threads.

8. A method as defined in claim 1; and further comprising reinforcing the knitting article by insertion of warp threads.

9. A method as defined in claim 1; and further comprising reinforcing the knitting article by insertion of multi-axial embedded threads.

10. A method as defined in claim 1; and further comprising knitting on the knitted article during its production of additional elements in an arbitrary direction relative to a knitting direction.

11. A method as defined in claim 10, wherein said additional elements are elements selected from the group consisting of shackles, loops and slings.

12. A method as defined in claim 1; and further comprising at least locally connecting additional elements with the knitted article.

13. A method as defined in claim 12, wherein said additional elements are formed as cords.

14. A method as defined in claim 12, wherein said additional elements are mounting elements.

15. A method as defined in claim 12, wherein said additional elements are closing elements.

16. A method as defined in claim 12, wherein said additional elements are formed as inserted weft threads.

17. A method as defined in claim 12, wherein said additional elements are formed as inserted warp threads.

18. A method as defined in claim 1; and further comprising producing at least one spherical region in the knitted article.

19. A method as defined in claim 1; and further comprising producing at least one region with corners and edges in the knitted article.

20. A method as defined in claim 1; and further comprising producing the knitted article as a seamless spherical knitting.

21. A method as defined in claim 1; and further comprising producing the knitted article in form of two connected pipes which are inserted in one another.

22. A method as defined in claim 21; and further comprising angling the pipes.

23. A spacial knitting produced by the method including the steps of knitting of knitting rows with a number and a width corresponding to a spacial structural of a knitting article to be produced, selecting a sequence of the knitting rows so that a uniform distribution of the knitting rows of different width and thereby reverse points in a knitting direction over the knitted article is provided, and for each loop row selecting a loop size so that a desired geometrical structure of the knitting article is obtained and no gusset lines are formed on the reverse points, said spacial knitting having at least one spherical region.

24. A spacial knitting produced by the method including the steps of the steps of knitting of knitting rows with a number and a width corresponding to a spacial structure of a knitting article to be produced, selecting a sequence of the knitting rows so that a uniform distribution of the knitting rows of different width and thereby reverse points in a knitting direction over the knitted article is provided, and for each loop row selecting a loop size so that a desired geometrical structure of the knitting article is obtained and no gusset lines are formed on the reverse points, said spacial knitting having at least one region with corners and edges.

25. A helmet insert produced by a method including the steps of knitting of knitting rows with a number and a width corresponding to a spacial structure of a knitting article to be produced, selecting a sequence of the knitting rows so that a uniform distribution of the knitting rows of different width and thereby reverse points in a knitting direction over the knitted article is provided, and for each loop row selecting a loop size so that a desired geometrical structure of the knitting article is obtained and no gusset lines are formed on the reverse points, said helmet insert being formed as a seamless spherical knitting.

26. A spacial knitting produced by the method including the steps of knitting of knitting rows with a number and a width corresponding to a spacial structure of a knitting article to be produced, selecting a sequence of the knitting rows so that a uniform distribution of the knitting rows of different width and thereby reverse points in a knitting direction over the knitted article is provided, and for each loop row selecting a loop size so that a desired geometrical structure of the knitting article is obtained and no gusset lines are formed on the reverse points, said spacial knitting having two connected pipes which are arranged in one another.

27. A special knitting as defined in claim 26, wherein said pipes are angled.

28. A knitting produced by the method including the steps of knitting of knitting rows with a number and a width corresponding to a spacial structure of a knitting article to be produced, selecting a sequence of the knitting rows so that a uniform distribution of the knitting rows of different width and thereby reverse points in a knitting direction over the knitted article is provided, and for each loop row selecting a loop size so that a desired geometrical structure of the knitting article is obtained and no gusset lines are formed on the reverse points, said knitting also having mounting elements in an arbitrary arrangement.

29. A knitting as defined in claim 28, wherein said mounting elements are knitted in the knitting.

30. A knitting as defined in claim 28, wherein said mounting elements are knitted on the knitting.

31. A knitting as defined in claim 28, wherein said mounting elements are elements selected from the group consisting of slings, loops and cords.

* * * * *